US007568671B2

(12) United States Patent
Lallier

(10) Patent No.: US 7,568,671 B2
(45) Date of Patent: Aug. 4, 2009

(54) ROOFING BRACKET APPARATUS AND SYSTEM

(76) Inventor: Mario Lallier, 214 Wallens Hill Rd., Winsted, CT (US) 06098

( * ) Notice: Subject to any disclaimer, the term of this patent is extended or adjusted under 35 U.S.C. 154(b) by 543 days.

(21) Appl. No.: 11/190,304

(22) Filed: Jul. 26, 2005

(65) Prior Publication Data

US 2007/0022702 A1 Feb. 1, 2007

(51) Int. Cl.
*A47G 29/02* (2006.01)

(52) U.S. Cl. ..... 248/237; 52/25; 182/45

(58) Field of Classification Search ..... 248/237, 248/148; 52/749.1, 24, 25, 26; 182/45
See application file for complete search history.

(56) References Cited

U.S. PATENT DOCUMENTS

| | | | | |
|---|---|---|---|---|
| 4,987,720 | A * | 1/1991 | Wozney, Jr. | 52/749.12 |
| 5,613,328 | A * | 3/1997 | Alley | 52/25 |
| 5,732,513 | A * | 3/1998 | Alley | 52/25 |
| 6,453,623 | B1 * | 9/2002 | Nelson et al. | 52/24 |
| 6,688,047 | B1 * | 2/2004 | McNichol | 52/25 |

* cited by examiner

*Primary Examiner*—Gwendolyn Baxter
(74) *Attorney, Agent, or Firm*—Robert L. Rispoli

(57) ABSTRACT

A novel roofing bracket is disclosed wherein use of a plurality of the roofing brackets provides a generally horizontal working surface on an inclined standing seam roofing panel. The roofing bracket comprises a first and second section, each section defining a base and an upright extending from the base, and a clamping mechanism for securely and removeably fastening the first section upright and the second section upright juxtaposed to one another abutting opposite sides of the standing seam. The roofing brackets further define a retaining element for engaging and retaining a plank suitable for providing a generally horizontal working surface.

9 Claims, 7 Drawing Sheets

ROOFING BRACKET APPARATUS AND SYSTEM

FIELD OF THE INVENTION

The present invention is generally directed toward an improved apparatus and system for enabling a worker to perform work on an inclined roof. More particularly, this invention provides an effective and efficient mechanism which may be securely and removeably attached to a standing seam roof panel and which is capable of supporting a worker thereon.

BACKGROUND OF THE INVENTION

Roofing brackets designed for positioning a platform and supporting a worker thereon are well known in the art of roofing. Typically, a roof is inclined such that a worker cannot safely perform work while standing or maneuvering on the inclined plane of the roof. As is known in the art, roofing brackets are secured to a roof and a platform is positioned and retained in place. The platform provides a generally horizontal plane on which a worker may be supported. After a particular section of roofing has been installed, the roofing brackets are removed and repositioned to enable the worker to safely reach another section of the roof.

One significant problem with the roofing brackets known in the art, particularly when installing standing seam roof panels, for example a metal roof, is that the roofing brackets are fastened to the roof using nails driven into the roof structure. Examples of conventional roofing brackets are disclosed in U.S. Pat. No. 6,698,702 to Macri. Both the prior art devices and the invention disclosed therein define features referred to as "nail slots." The use of nail slots permits the roofing bracket to be removeably secured to the roof structure. Typically, the roofing bracket is struck with a hammer to disengage the nail slots from the nails driven into the roof structure.

As is known in the art, the use of nails to temporarily fasten a roofing bracket to the underlying roof structure is incompatible with the installation of standing seam roof panels. The nail holes are detrimental to the standing seam roof panel substrate. What is needed in the art is a roofing bracket that may be securely and removeably positioned on standing seam roof panels.

One example of a device that recognizes this problem with the prior art devices provides a complex and correspondingly problematic alternative. The device is commercially known as the Brucie Bracket and is commercially available from Lincoln Equipment Associates, Inc., located in West Medford, Mass. The prior art device employs an intricate array of welded members and other structural components. The problems with this device known to those skilled in the art render this device difficult to use.

When maneuvering equipment on a roof, and up and down a series of ladders, the weight of such equipment is a critical feature. Another critical feature in such a device is the complexity of its use; preferably, it may be installed with one hand. The prior art device known as the Brucie Bracket weighs approximately 34 pounds and requires two hands to position and securely attach to a standing seam. In addition, the complexity of the device and the ultimate positioning of the platform defines an unsafe gap between the platform and the roof panel such that a worker's ankle could pass through the gap and result in substantial injury to the worker. Moreover, the device's complexity increases its cost to manufacture and procure.

Accordingly, there is a need in the art for an improved roofing bracket to provide a level working surface from which worker may install a standing seam roof panel.

SUMMARY OF THE INVENTION

The present invention provides an improved apparatus for enabling a worker to effectively and efficiently perform work on an inclined roof comprising standing seam roof panels. The present invention provides a comparatively lightweight and simple roofing bracket that may be securely and removeably attached to a metal roof. The present invention also provides a greater degree of flexibility such that a generally horizontal platform may be provided for a greater degree of incline of roof.

DETAILED DESCRIPTION OF THE DRAWINGS

Figure 1:
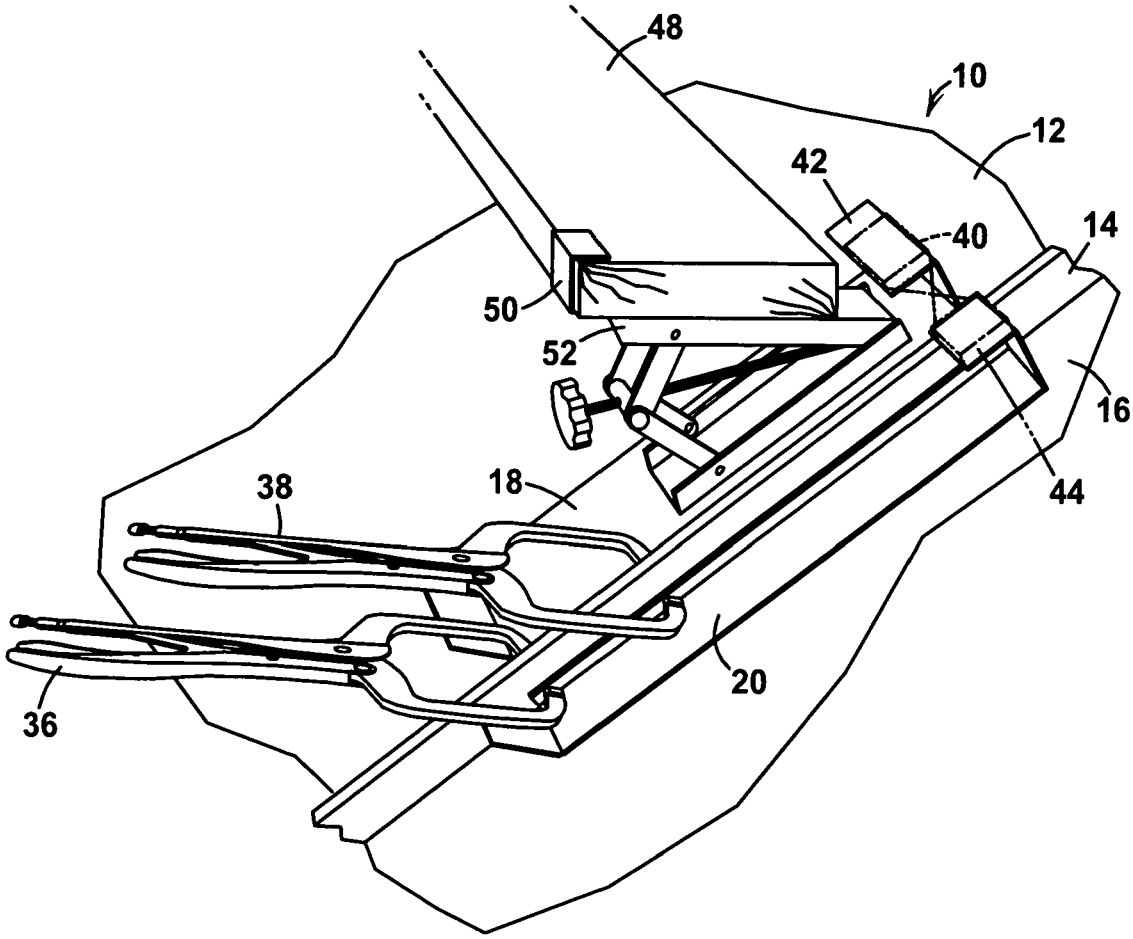
FIG. 1 provides an isometric view of one embodiment of a roofing bracket of the present invention.

A preferred embodiment of the present invention is shown in FIG. 1. Roofing bracket 10 is positioned on an inclined roof 12 comprising standing seam 14 roof panels 16. Roofing bracket 10 defines a first section 18 and a second section 20 positioned adjacent to and on opposite sides of standing seam 14. First section 18 and a second section 20 may be fabricated from a variety of materials known in the art such as, for example, steel, aluminum, wood, or synthetic materials.

Figure 2:
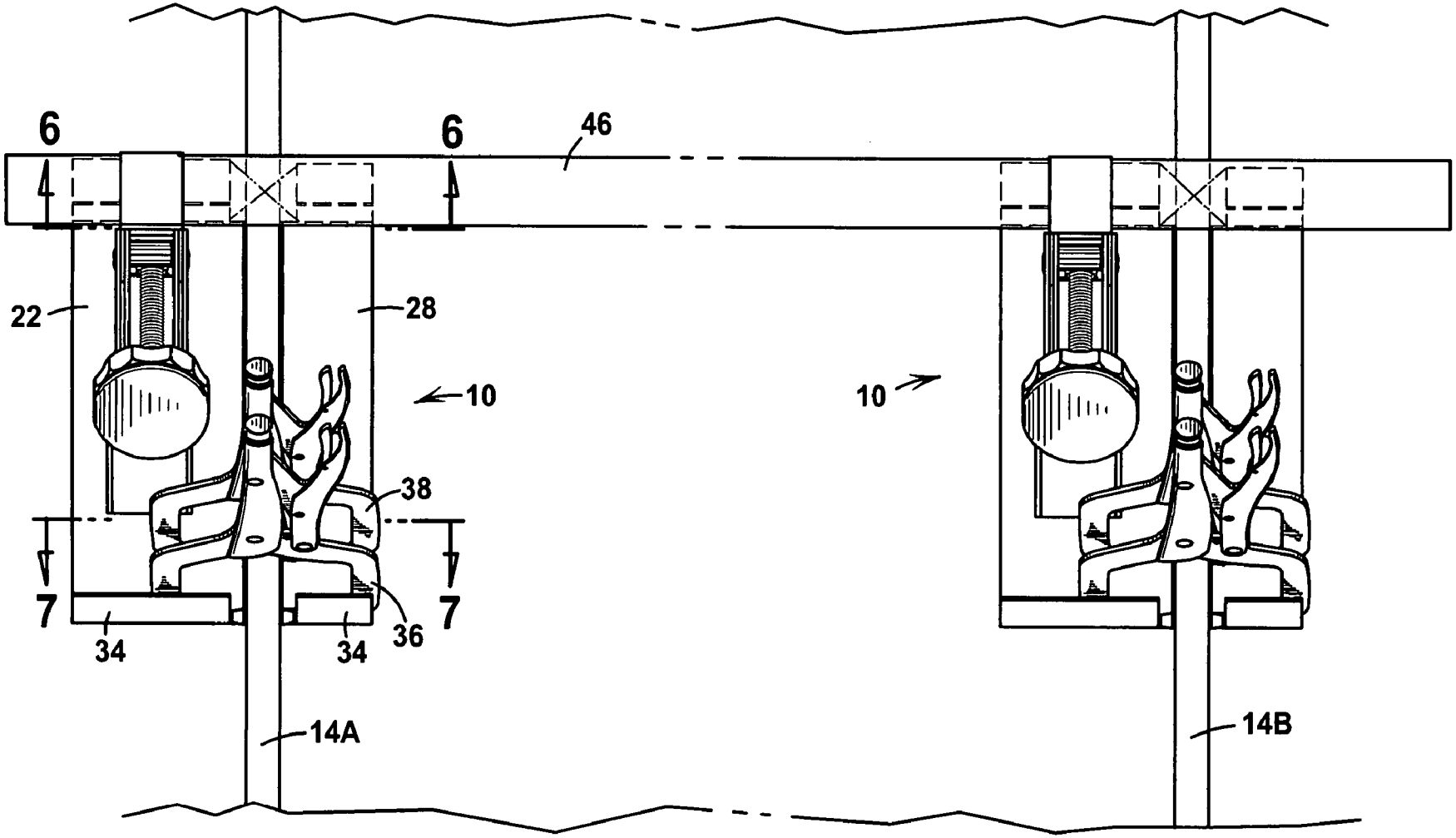
FIG. 2 provides an isometric view of a pair of roofing brackets depicted in FIG. 1 securely and removeably attached to a standing seam metal roof.
Figure 6:
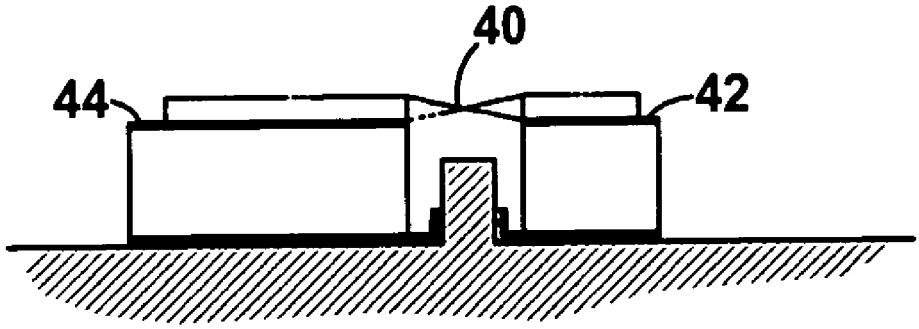
FIG. 6 provides a profile view of a roofing bracket of FIG. 2 taken along line 6.
Figure 7:
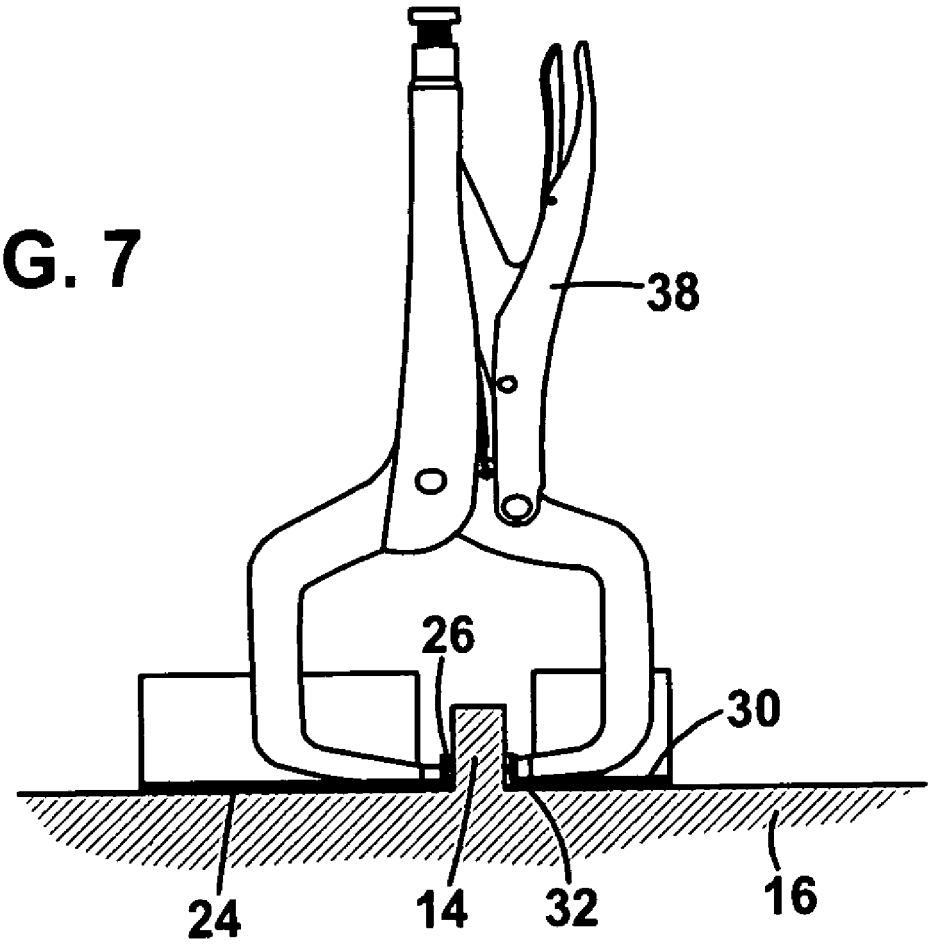
FIG. 7 provides a profile view of a roofing bracket of FIG. 2 taken along line 7.

As shown in FIG. 2, FIG. 6 and FIG. 7, first section 18 defines a base 22 designed to be positioned upon a roof panel 16. Preferably, base 22 comprises a padding 24 designed to protect the finish of roof panel 22. Padding 24 may be fabricated from a variety of materials known in the art such as, for example, rubber. Base 22 and padding 24 may be joined by any conventional means suited for the materials that comprise base 22 and padding 24; for example, rubber padding may be joined to an aluminum base by any conventional adhesive means. First section 18 also defines an upright 26 extending upward therefrom such that upright 26 may be positioned proximate to standing seam 14. Similarly, second section 20 defines a base 28, a padding 30, and an upright 32. First section 18 and a second section 20 also may define a rear upright 34 for ease-of-use purposes.

First section 18 and a second section 20 are capable of supporting at least one, preferably two, and potentially more than two, clamping mechanisms such that upright 26 of first section 18 and upright 32 of second section 20 may be securely and removeably fastened juxtaposed to one another abutting opposite sides of standing seam 14. The clamping mechanism may comprise any number of clamping mechanisms known in the art such as conventional vise grips 36 and 38. The clamping mechanism is secured to first section 18 and a second section 20 by any conventional means, such as, for example, welding.

Figure 3:
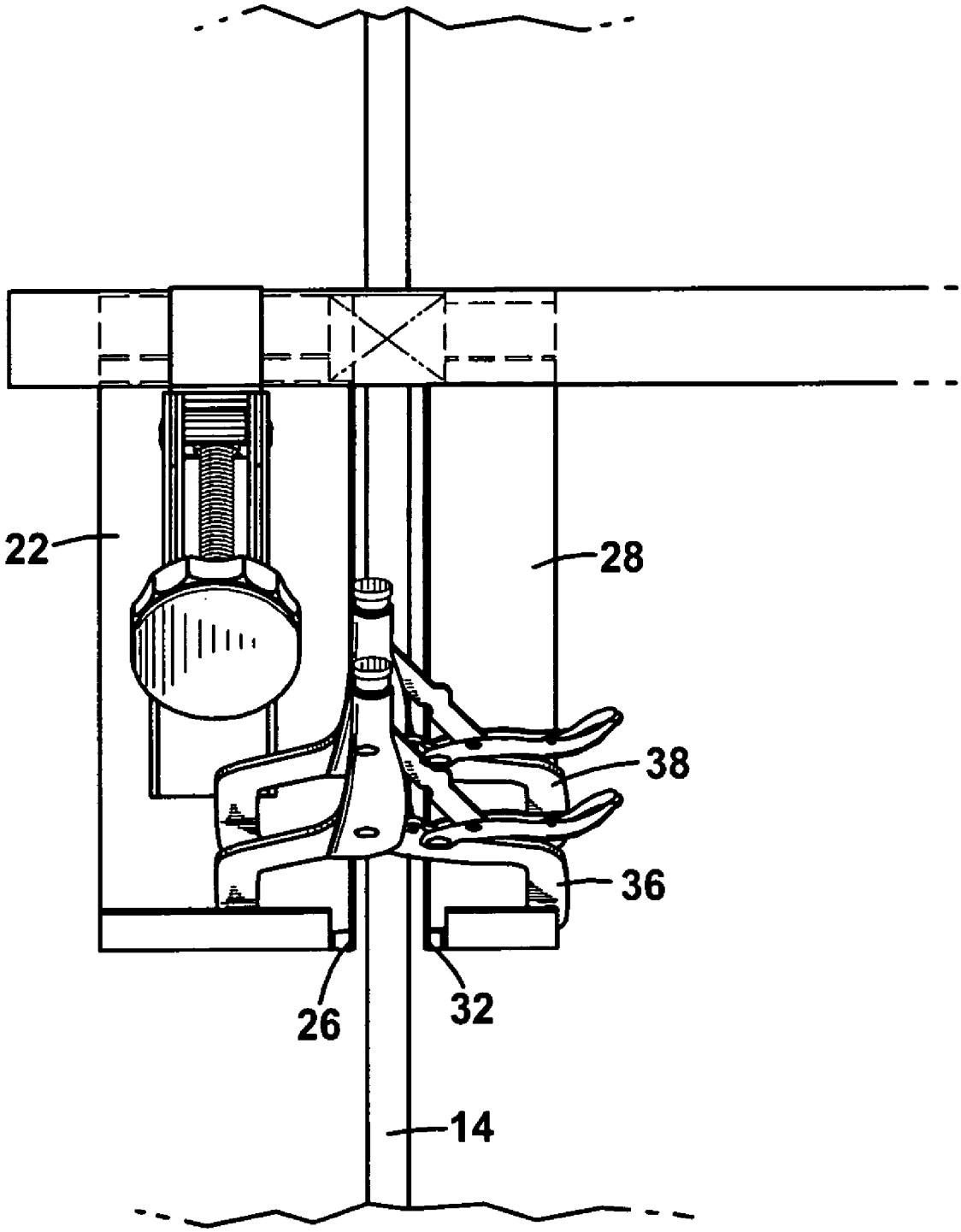
FIG. 3 provides an isometric view of a roofing bracket of FIG. 1 where the clamping mechanisms are in an open configuration.

As shown in FIG. 3, first section 18 and a second section 20 are positioned juxtaposed to one another such that upright 26 and upright 32 are abutting opposite sides of standing seam 14. Clamping mechanisms 36 and 38 are depicted in an open position. Once closed and secured as depicted in FIG. 2 and FIG. 7, roof bracket 10 is securely fastened to standing seam 14 and roof panel 16. Alternatively, as shown in FIG. 1 and FIG. 6, the clamping mechanism may comprise any conventional clamping means 40 or other mechanical link interconnecting substantially coplanar plates 42 and 44.

As shown in FIG. 1 and FIG. 2, a generally horizontal platform 46 is provided by inserting a plank 48 between at least two roofing brackets 10 securely fastened to standing seams 14A and 14B. Preferably, plank 48 comprises a hardwood 2 in.-×-12 in. plank of sufficient length to span standing seams 14A and 14B. As best shown in FIG. 1, Plank 48 is positioned within retaining element 50 designed to engage plank 48. Retaining element 50 is positioned upon a radial extension element 52 such that retaining element 50 may be radially extended upward from inclined roof 12 whereby plank 48 is positioned to provide generally horizontal platform 46. As shown in FIG. 2 and FIG. 3, radial extension element 52 is positioned upon and fixedly attached to base 22 of first section 18. Alternatively, radial extension element 52 may be positioned upon and fixedly attached to base 28 of second section 20.

Figure 4:
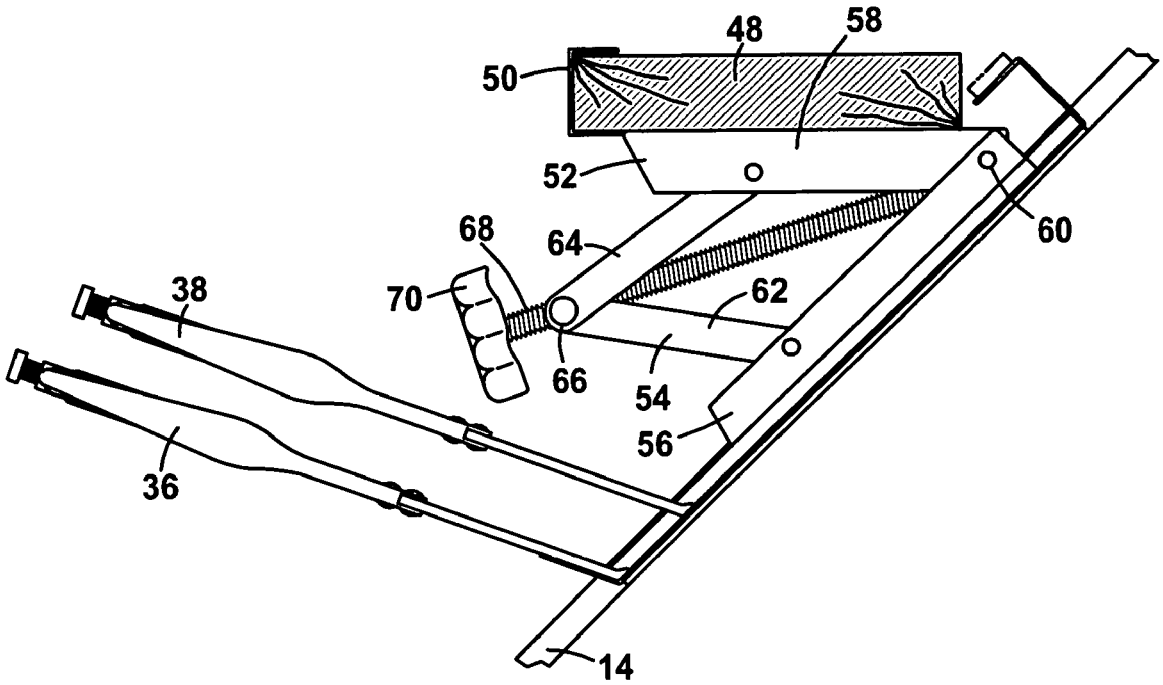
FIG. 4 provides a profile view of a roofing bracket of FIG. 1 where the radial extension element provides a generally horizontal platform on an inclined roof.
Figure 5:
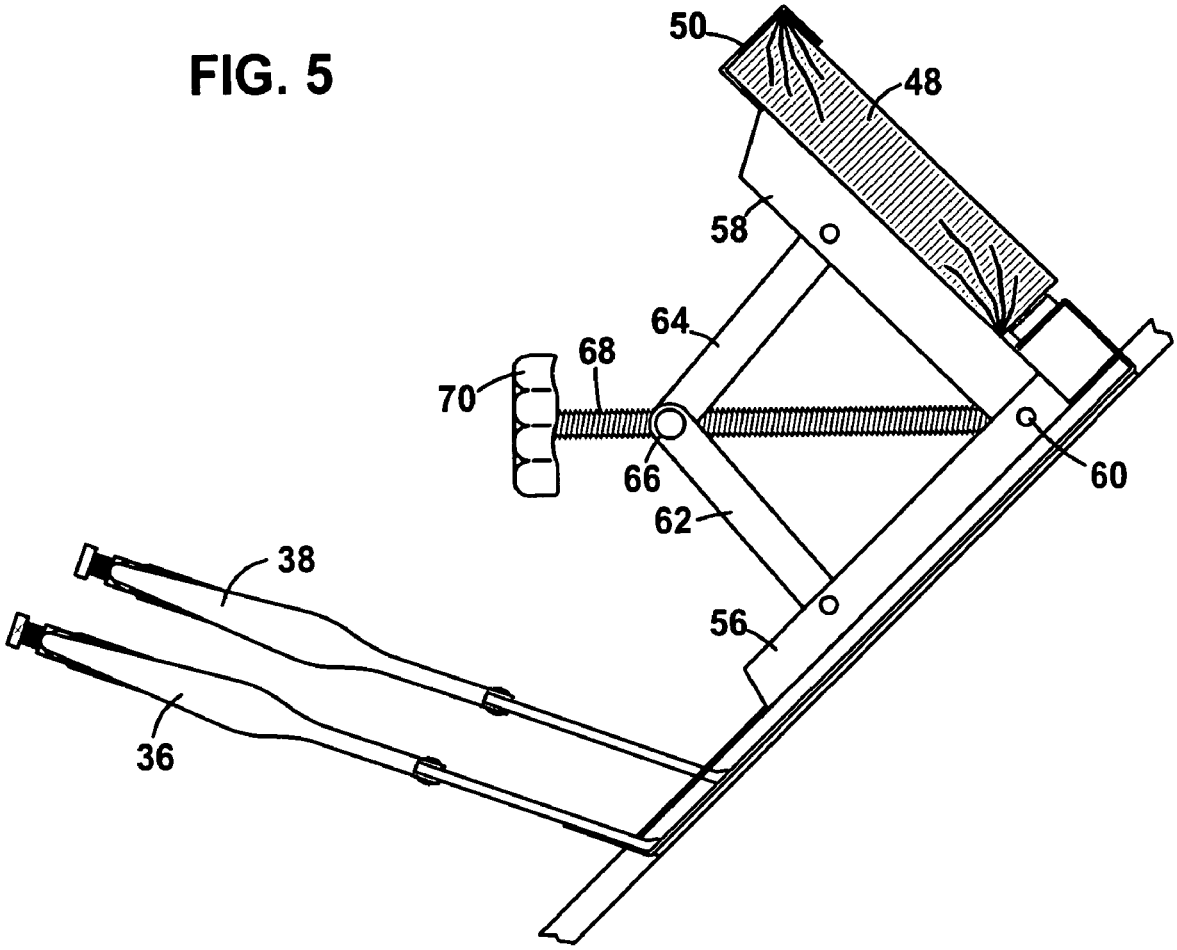
FIG. 5 provides a profile view of a roofing bracket of FIG. 4 where the radial extension element is extended to provide a platform approximately 90° to the inclined roof.

In a preferred embodiment of the invention and as shown best in FIG. 4 and FIG. 5, radial extension element 52 comprises a leveling roof platform support 54. The leveling roof platform support 54 is described in U.S. Pat. No. 5,979,600 to Bitner, which patent is incorporated herein in its entirety. Leveling roof platform support 54 is commercially known as Extreme Roof Jack™ and commercially available from Lynn Ladder and Scaffolding, Lynn, Mass. Leveling roof platform support 54 is commonly known and referred to herein as a "screw jack." Screw jack 54 comprises a base 56 and a support member 58 pivotally joined to base 56 at pivot joint 60. Screw jack 54 further comprises extendable support arms 62 and 64 pivotally joined at one end to each other at pivot joint 66. Extendable support arm 62 is pivotally joined at the other end to base 56, and extendable support arm 64 is pivotally joined at the other end to support member 58.

Pivot joint 66 defines a threaded insert that engages screw 68 such that the rotation of handle 70 causes pivot joint 66 to move either toward or away from pivot joint 60, and correspondingly causes support member 58 to rotate about pivot joint 60 to position plank 48 in a generally horizontal orientation. Screw jack 54 is shown in FIG. 4 such that support member 58 is positioned with a lower angular differentiation from base 56. By rotating handle 70 such that pivot joint 66 moves toward pivot joint 60, as shown in FIG. 5, support member 58 is positioned with a greater angular differentiation from base 56. The configuration defined by screw jack 54 permits an angular rotation of support member 58 from base 56 of approximately 12° to approximately 90°.

Figure 8:
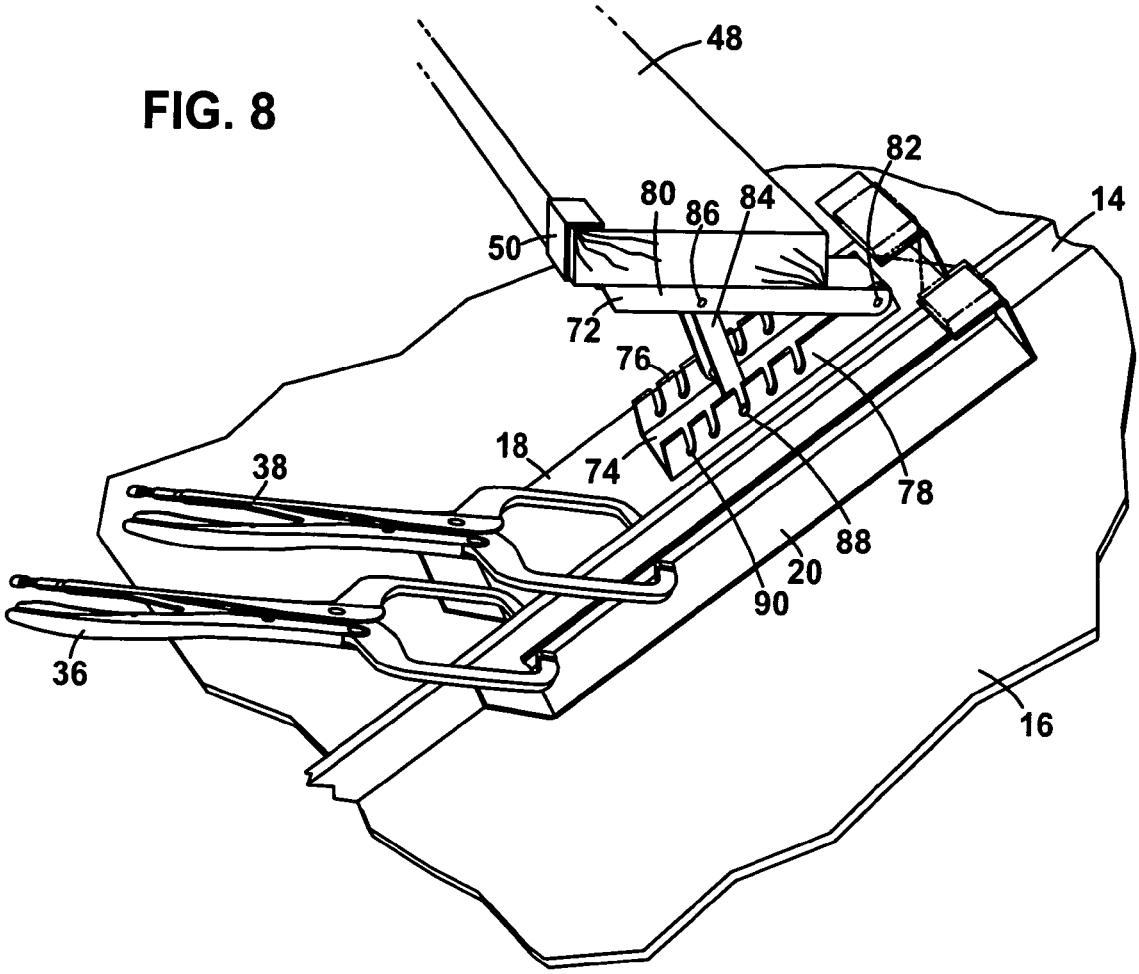
FIG. 8 provides an isometric view of another embodiment of a roofing bracket of the present invention comprising an alternative radial extension element.

In another embodiment of the invention and as shown in FIG. 8, radial extension element 52 comprises a conventional mechanical lift mechanism 72. Mechanical lift mechanism 72 comprises a base 74 and uprights 76 and 78 extending upward therefrom. Mechanical lift mechanism 72 further comprises support member 80 pivotally joined to base 74 at pivot joint 82. Extendable support arms 84 extending downward from, and are pivotally joined to, support member 80 at pivot joint 86. Uprights 76 and 78 define slots 90 designed to engage pins 88 extending from uprights 76 and 78. The configuration defined by mechanical lift mechanism 72 permits an angular rotation of support member 80 about pivot joint 82 by positioning pins 88 extending from uprights 76 and 78 into the desired slots 90.

While the present invention has been described in considerable detail, other configurations exhibiting the characteristics taught herein for providing a comparatively lightweight and simple roofing bracket that may be securely and removeably attached to a metal roof are contemplated. It will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, the spirit and scope of the invention should not be limited to the description of the preferred embodiments described herein.

What is claimed is:

1. A roofing bracket for providing a generally horizontal working surface on an inclined standing seam roofing panel, the roofing bracket comprising:

a) a first section;

b) a second section;

c) the first section and the second section each defining a base;

d) the first section and the second section each defining an upright extending from the base wherein the first section upright and the second section upright may be positioned proximate to a standing seam of a roofing panel;

e) a clamping mechanism fixedly attached to the first section and the second section for securely and removeably fastening the first section upright and the second section upright juxtaposed to one another abutting opposite sides of the standing seam;

f) an extension element comprising a screw-jack lifting mechanism fixedly attached to the base of the first section or the second section; and g) a retaining element fixedly attached to the extension element for engaging and retaining a plank suitable for providing a generally horizontal working surface.

2. The roofing bracket of claim 1 wherein the first section base and the second section base further comprise padding on a surface abutting the roofing panel.

3. The roofing bracket of claim 1 wherein the clamping mechanism comprises at least one vise grip.

4. A method for providing a generally horizontal working surface on an inclined standing seam roofing panel, the system comprising:

a) providing a plurality of roofing brackets wherein each roofing bracket further comprises a first section, a second section, the first section and the second section each defining a base and an upright extending from the base, a clamping mechanism, and a retaining element;

b) positioning the roofing brackets wherein the first section upright and the second section upright are proximate to a standing seam of a roofing panel;

c) securely and removeably fastening the first section upright and the second section upright juxtaposed to one another abutting opposite sides of the standing seam;

d) placing a plank suitable for providing a generally horizontal working surface between the roofing brackets positioned within the retaining element of the roofing brackets; and e) adjusting the retaining elements wherein the plank provides a generally horizontal working surface and provides a screw-jack lifting mechanism.

5. The method of claim 4 wherein the first section base and the second section base further comprise padding on the surface abutting the roofing panel.

6. The method of claim 4 wherein the step of securely and removeably fastening the first section upright and the second section upright further comprises providing at least one vise grip.

7. A roofing bracket for providing a generally horizontal working surface on an inclined standing seam roofing panel, the roofing bracket comprising:

a) a first section;

b) a second section;

c) the first section and the second section each defining a base;

d) the first section and the second section each defining an upright extending from the base wherein the first section upright and the second section upright may be positioned proximate to a standing seam of a roofing panel;

e) a means for securely and removeably fastening the first section upright and the second section upright juxtaposed to one another abutting opposite sides of the standing seam wherein such means is fixedly attached to the first section and the second section;

f) a means for radially extending an extension element comprising a screw-jack lifting mechanism fixedly attached to the base of the first section or the second section; and f) a means for engaging and retaining a plank suitable for providing a generally horizontal working surface wherein such means is fixedly attached to the extension element.

8. The roofing bracket of claim 7 wherein the first section base and the second section base further comprise padding on a surface abutting the roofing panel.

9. The roofing bracket of claim 7 wherein the means for securely and removeably fastening the first section upright and the second section upright comprises at least one vise grip.

* * * * *